United States Patent [19]

Johansson et al.

[11] 4,339,047

[45] Jul. 13, 1982

[54] COLLAPSIBLE STORAGE AND TRANSPORT CRATE CAPABLE TO BE STACKED

[75] Inventors: Ingvar H. Johansson; Helle G. Johansson, both of Alvesta; Kurt Webing, Helsingborg; Gunnar Thulin, Ängelholm, all of Sweden

[73] Assignee: AB Maskinarbeten, Alvesta, Sweden

[21] Appl. No.: 171,819

[22] Filed: Jul. 24, 1980

[51] Int. Cl.[3] ..... B65D 21/02; B65D 88/02; B65D 6/18

[52] U.S. Cl. ..... 220/1.5; 220/6; 220/7; 206/509; 206/511; 206/512

[58] Field of Search ..... 220/1.5, 6.7; 206/509, 206/510, 511

[56] References Cited

U.S. PATENT DOCUMENTS

| | | | |
|---|---|---|---|
| 2,664,219 | 12/1953 | Schmidt | 220/1.5 |
| 3,557,855 | 1/1971 | Weingarten | 220/1.5 |
| 4,147,289 | 4/1979 | Crane | 206/509 |
| 4,186,841 | 1/1980 | Buckley | 220/1.5 |

FOREIGN PATENT DOCUMENTS

| | | | |
|---|---|---|---|
| 735258 | 8/1955 | United Kingdom | 220/6 |
| 741969 | 12/1955 | United Kingdom | 206/511 |

*Primary Examiner*—George E. Lowrance
*Attorney, Agent, or Firm*—Sherman & Shalloway

[57] ABSTRACT

The invention relates to a collapsible transport and storage crate capable to be stacked. The sides (5) of the crate are provided with pins (13) sunk into connecting pieces (4) at the bottom of the crate. Upon folding down the sides they are lifted so that the pins (13) are pulled out of the connecting pieces (4) and are folded down hinged at them inward against the bottom. Thereby guide bosses (12) reach above the geometry of the folded-down crate and fix a crate located thereabove. In outfolded state tips (17) located on the upper edges of the sides can engage with pockets (15) located in the bottom of a crate thereabove and thereby fix said crate in lateral direction.

3 Claims, 4 Drawing Figures

COLLAPSIBLE STORAGE AND TRANSPORT CRATE CAPABLE TO BE STACKED

This invention relates to collapsible storage and transport crates, which can be stacked one above the other in both collapsed and unfolded state and are intended particularly but not exclusively to receive compressed building insulation material; such as mineral wool. The crate consists of a square bottom and two lateral pieces located directly in front of each other in such a manner, that the bottom is formed so as to permit handling of the crate from all four sides by means of, for example, a fork truck.

This type of crates in spite of its collapsibility is relatively bulky and in collapsed state cannot be stacked one upon the other, nor can they even in empty state be stacked above each other. Stacking is here to be understood so that the crates merely are placed one above the other, without fixing them laterally relative to each other. The known collapsible crates cannot take up great lateral forces on their sides and, therefore, their application range is restricted. They cannot, for example, be used for storing compressed building insulation material, which is compressed to about one third of its original volume and thereby applies a substantial pressure on the sides of the crates.

Due to the characterizing features having been given to the present invention, a collapsible storage and transport crate has been obtained, several of which can be stacked upon each other, in which crate the aforesaid inconveniencies are eliminated, and which opens a new field of application. The new creates require less storage space and reduce the transport costs compared with the conventional crates. The crate, for example, can be loaded and unloaded rapidly on and from trucks and goods wagons.

Figure 1:
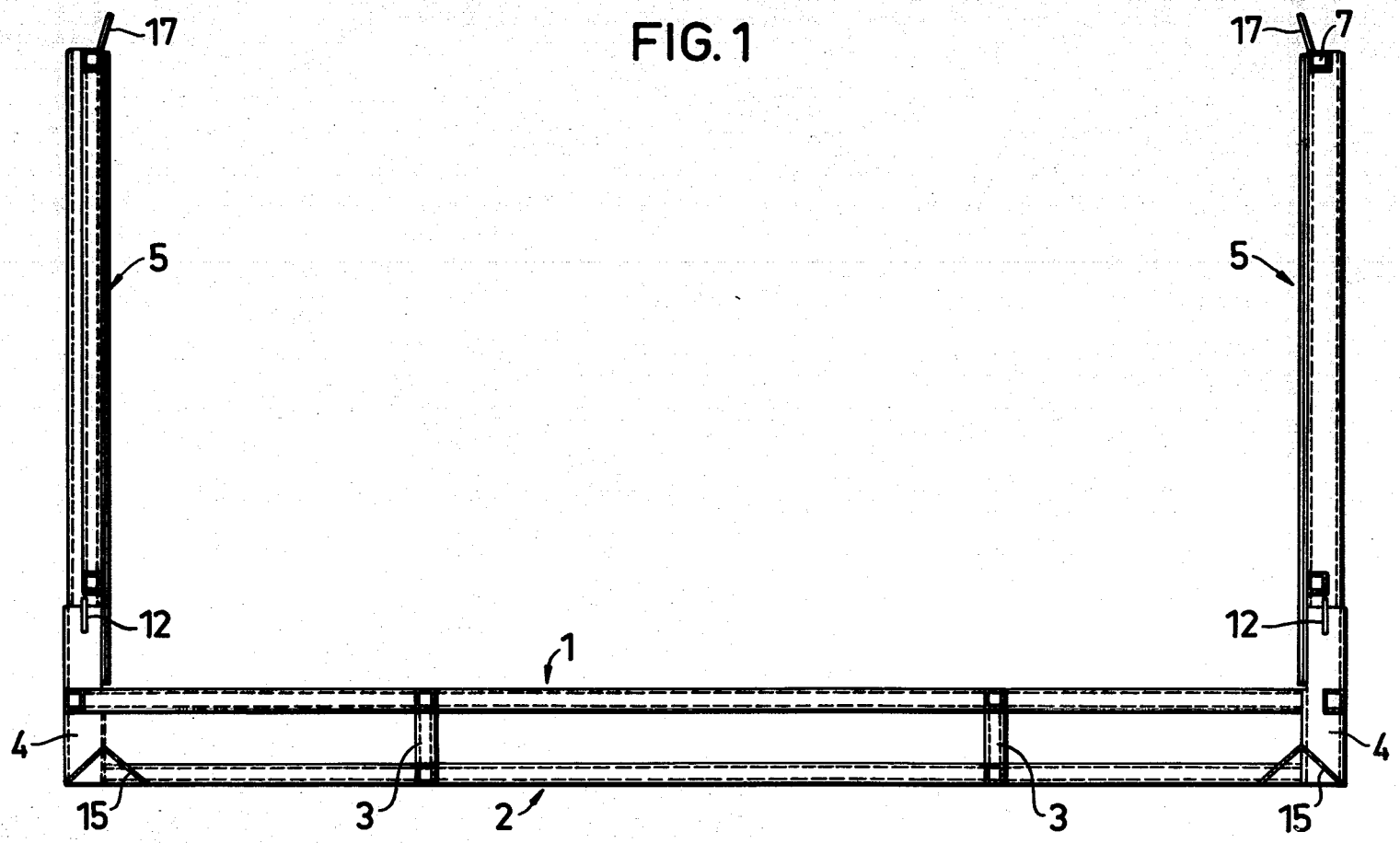
Figure 2:
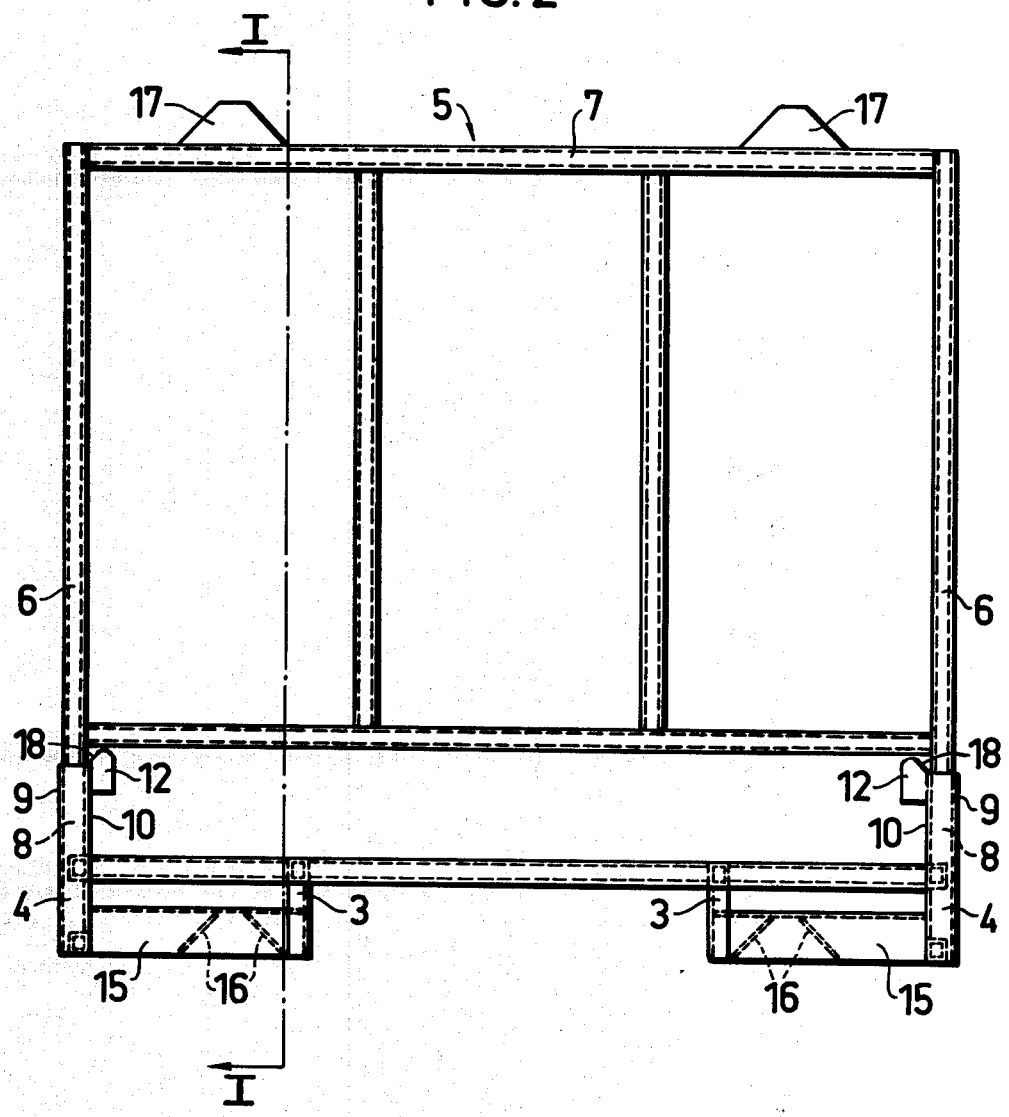
Figure 3:
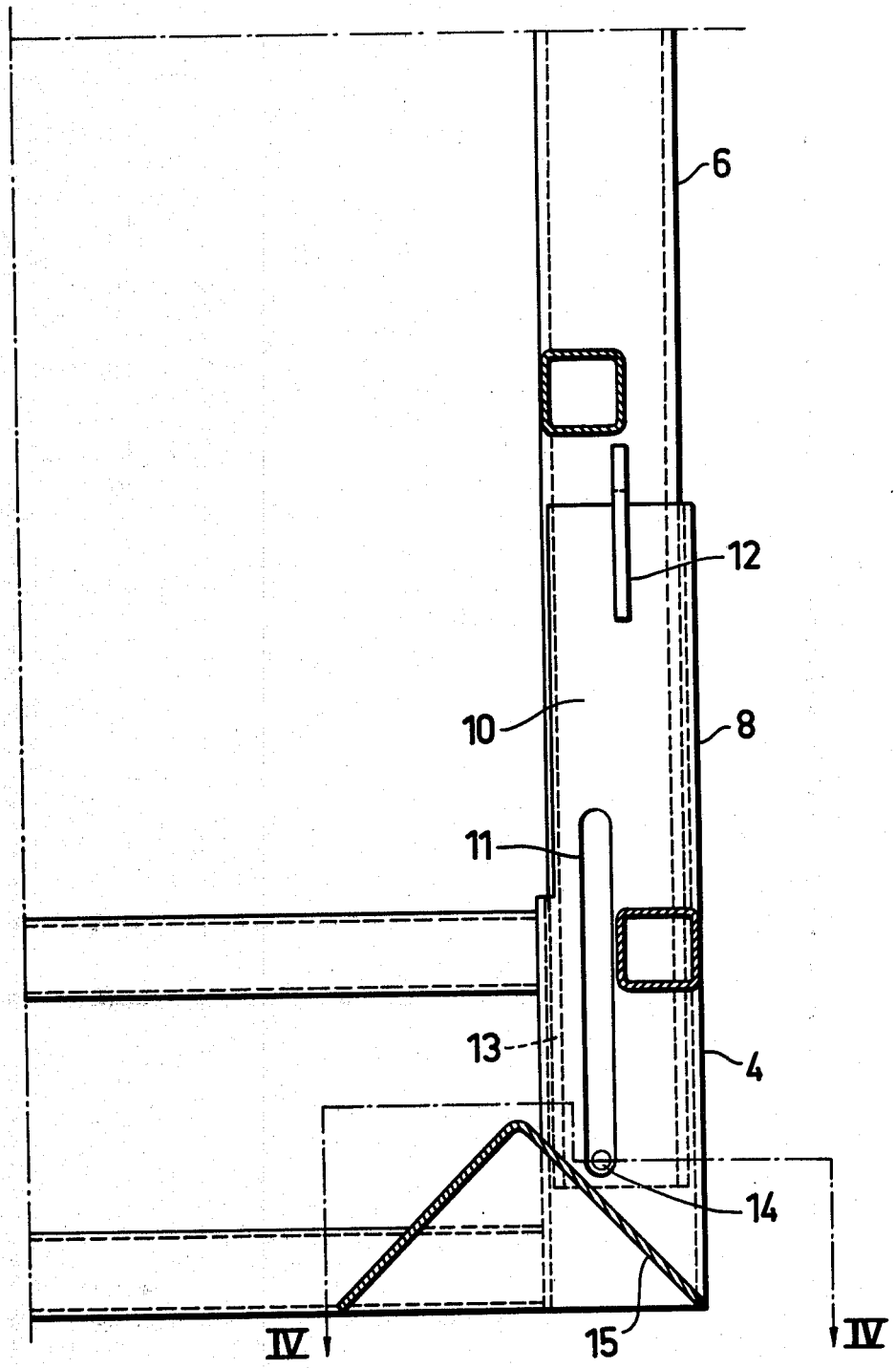
Figure 4:
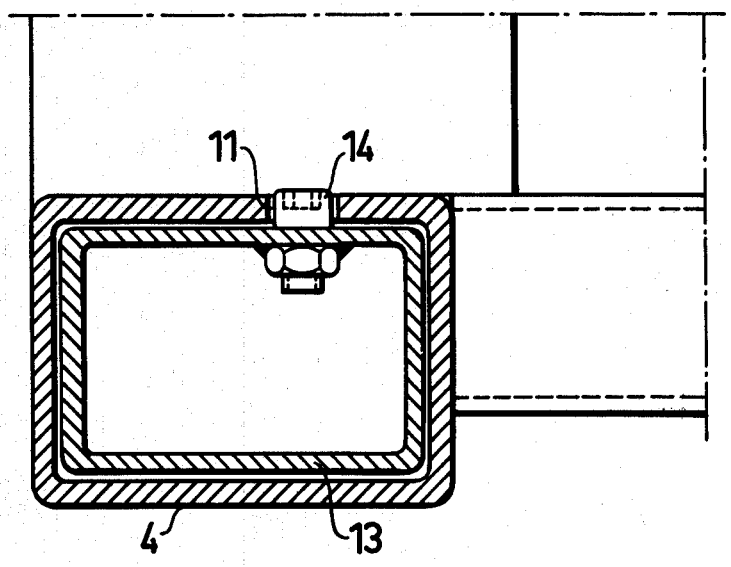

The invention is described in greater detail in the following by way of an embodiment, with reference to the drawings, in which FIG. 1 is a section of the crate from the side, FIG. 2 is an end view of the crate, FIG. 3 shows a corner on an enlarged scale, and FIG. 4 is a section along the line IV—IV in FIG. 3.

The bottom of the crate consists of a frame system in two planes 1 and 2 which is resistant to bending. The planes are interconnected by struts 3 and hollow corner connecting pieces 4, rendering it thereby possible to handle the crate from all four sides, for example by means of a fork truck.

The lateral pieces of the crate are designated by 5 and consist a.o. each of two lateral frame members 6 and an upper frame member 7.

The respective corner connecting piece extends, as appears from FIGS. 1–3, from the plane 2 at least up to the upper or floor surface of the bottom. The shell surface of the connecting piece 4 is extended upward above the floor side by a portion 8, which faces outward from the crate and is located in a plane parallel to the lateral piece 5, with the portions 9, 10 extending perpendicularly thereto.

That portion of the extension of the connecting piece which faces the opposed lateral piece, thus, will be open. The connecting piece further is provided on the inside and on a portion of the extension 10 with a vertical groove 11. A guide boss 12 also is located on the inside of the extension of the connecting piece and extends with a portion above the upper end of the connecting piece, as clearly appears from FIGS. 1–3.

The frame members 6 of the lateral piece 5 in question form at the lower end a pin 13, which movably fits into the connecting piece 4. As appears from FIG. 3, the pin is provided downwardly with a guide head 14, which extends into and runs along the groove 11, which defines the upward and downward movements of the head 14 and therewith of the lateral piece 5. The head 14 preferably is a screw head with hexagonal recess which with a nut has been screwed firmly on the pin and been welded thereon. In the position shown in FIG. 3 the pins of the lateral frame members 6 are sunk into the connecting pieces 4, and the heads 14 rest against the bottom of the groove 11. The lateral piece 5 of the crate hereby is held upright in relation to the bottom, and the entire connecting piece together with its extension 8 can take up the forces acting outward on the lateral piece.

For folding down the lateral piece 5 it is lifted so that the head lands in the upper position of the groove 11, and the lateral piece 5 is folded down against the bottom. This is possible due to the fact that the connecting piece 4 extends only to the floor side of the bottom and has no extension on the side facing to the centre of the crate.

The bottom is provided on the lower surface with downwardly open angular sections 15, which extend along the plane of the respective lateral piece, as appears from FIGS. 1–3. Within said sections 15 walls or flanges 16 are arranged, see FIG. 1, which form a pyramidal pocket. The respective lateral piece further is provided with two tongues 17, which are located straight above the respective pocket. The tongues are inclined slightly to the centre of the crate.

When the lateral pieces 5 are folded down, the guide bosses 12 reach above the geometry of the collapsed crate. A crate, which is being placed upon said collapsed crate will be aligned by means of the inclined edge 18 and be fixed laterally by said bosses, which engage inside of the connecting pieces with the crate thereabove and simultaneously engage within the angular sections 15.

When the lateral pieces 5 are erected, a crate can be placed above the unfolded crate and be fixed laterally in relation to the same, in that the tongues 17 at the lower crate will be guided into the pyramidal pockets of the crate thereabove.

The above description should disclose clearly the design and function of the crate according to the invention. The crate can be varied in different ways within the scope of the invention. The connecting pieces, for example, may be circular in section, and the lateral frame members may correspondingly be tubular.

We claim:

1. A collapsible storage and transport crate capable of being stacked upon each other, each crate consisting of a square bottom (1,2) and two lateral pieces (5) arranged straight opposite to each other, which bottom is formed for handling the crate from all its four sides, and provided in each corner with an upwardly open pipe connecting piece (4) which is extended above the floor surface of the bottom by a portion of its shell surface (8) facing outward of the crate and is further provided with a slit (11) extending in the longitudinal direction of the connecting piece (4) in a plane parallel to the lateral piece, the lateral piece (5) being provided at its lower portion with downwardly directed pins (13), which are axially movable in two adjacent connecting pieces (4)

and that heads (14) attached to the pins and extending perpendicularly to the pins extend into said respective slit (11), the bottom (1,2) having lower longitudinal frame stays extending between the lowermost ends of the connecting pieces and the lower sides of which are on a level with planes extending through the lower end sides of the connecting pieces (4), each connecting piece (4) having a guide boss (12) arranged with one guide surface (18) extending along the plane of the lateral piece towards the opposed connecting piece and starting from the inner edge of the upper end of the connecting piece and obliquely upwards to a point above the upper end side of the connecting piece (4) lying on a horizontal plane, a downwardly open V-shaped profile (15) starting from the inner edge of the respective connecting piece being arranged below and along the respective lateral piece (5), walls (16) being arranged in the profile converging towards each other to form two downwardly open pyramid-shaped pockets spaced from the connecting piece (4), the lower edges of the profiles being on a level with the lower end sides of the connecting pieces, and each lateral piece (5) having on its upper edge two upwards wedge-shaped tongues (17) extending above the upper edge and inclined towards the center of the crate, each intended to fit into each its pocket of a crate placed above crates, so that when the crates are stacked upon each other, the lower end sides of the connecting pieces (4) of a crate placed above is guided by unfolded lateral pieces to a position resting on the upper end side of the respective connecting piece by means of the guide surfaces of the guide bosses (12) and the V-shape of the profiles.

2. A transport crate as defined in claim 1, characterized in that the connecting piece has square cross-section.

3. A transport crate as defined in claim 1, characterized in that the connecting piece has circular cross-section.

* * * * *